US007120262B2

(12) United States Patent
Klinke

(10) Patent No.: US 7,120,262 B2
(45) Date of Patent: Oct. 10, 2006

(54) DIRECTIONAL-MICROPHONE AND METHOD FOR SIGNAL PROCESSING IN SAME

(75) Inventor: Stefano Ambrosius Klinke, Düsseldorf (DE)

(73) Assignee: Siemens Aktiengesellschaft, Munich (DE)

( * ) Notice: Subject to any disclaimer, the term of this patent is extended or adjusted under 35 U.S.C. 154(b) by 505 days.

(21) Appl. No.: 10/296,351

(22) PCT Filed: May 17, 2001

(86) PCT No.: PCT/DE01/01887

§ 371 (c)(1),
(2), (4) Date: May 7, 2003

(87) PCT Pub. No.: WO01/91512

PCT Pub. Date: Nov. 29, 2001

(65) Prior Publication Data

US 2003/0174852 A1 Sep. 18, 2003

(30) Foreign Application Priority Data

May 25, 2000 (DE) ..... 100 26 078

(51) Int. Cl.
*H04R 3/00* (2006.01)

(52) U.S. Cl. ..... 381/92

(58) Field of Classification Search ..... 381/92, 381/356, 357
See application file for complete search history.

(56) References Cited

U.S. PATENT DOCUMENTS

| | | | | |
|---|---|---|---|---|
| 5,715,319 | A | 2/1998 | Chu | |
| 2003/0142836 | A1* | 7/2003 | Warren et al. | 381/92 |
| 2004/0105557 | A1* | 6/2004 | Matsuo | 381/92 |

* cited by examiner

*Primary Examiner*—Brian Pendleton
(74) *Attorney, Agent, or Firm*—Bell, Boyd & Lloyd LLC

(57) ABSTRACT

Provided is a directional-microphone system, as well as a method for signal processing in such a directional-microphone system, wherein a particularly controllable second-order directional-microphone pattern is ensured while the number of figure-of-eight microphones required to generate such pattern is minimized.

10 Claims, 1 Drawing Sheet

DIRECTIONAL-MICROPHONE AND METHOD FOR SIGNAL PROCESSING IN SAME

BACKGROUND OF THE INVENTION

Directional microphones are an effective way to facilitate the comprehension of voice in an environment full of interfering sound since they have a sensitivity depending on the direction of the incidence of sound (directional pattern) and, thus, produce a spatial suppression of interfering sounds.

Directional pattern or directional effect describes the ratio of the sensitivities of a microphone to sound sources impinging on the microphone from all directions of one plane and essentially depends on the construction of the microphone. Known directional patterns are spherical or omnidirectional, figure-of-eight or bidirectional, cardioid, supercardioid, hypercardioid and lobe pattern.

The spherical pattern is distinguished by the fact that the sound is picked up with the same strength from all directions. A microphone having a spherical pattern is, for example, the "pressure transducer", the diaphragm of which, only the front of which is exposed to the sound field, picks up all pressure fluctuations located in the sound field regardless of the direction from which they come. Since this microphone does not have a preferred directional effect, it has a spherical pattern and is frequently called a "spherical microphone".

A figure-of-eight pattern is distinguished by the fact that the sound is picked up with particular intensity from two selected directions which are opposite to one another. Microphones having a figure-of-eight pattern, also called "figure-of-eight microphones", have been developed for, among other things, the M/S stereo method and enable the stereo base to be subsequently influenced right up to mono.

A microphone having a figure-of-eight pattern is, e.g., the "pressure-gradient transducer" or "pressure-difference transducer" which is designed in such a way that the sound reaches the diaphragm both from the front and from the back, which requires two sound entry openings so that the diaphragm is not deflected when sound arrives from the side and a "figure-of-eight" directional pattern is guaranteed.

A further possibility of achieving a figure-of-eight pattern which, moreover, is more flexible than the purely mechanical arrangement of the pressure-gradient transducer, is an arrangement of two simple spherical microphones which are slightly offset in space (array). The directional effect is obtained by electronically subtracting the spherical-microphone signal at the front (from the point of view of the incident sound) from the delayed signal of the spherical microphone at the rear. The precise shape of the directional pattern is defined by the microphone spacing and the internal electrical delay.

The pressure-difference or pressure-gradient transducer supplies a signal proportional to $\cos(\alpha)$ with a sound incident at an angle $\alpha$ and is, therefore, a directional microphone having a first-order directional pattern.

Dispensing with close-talking microphones in telephones, in video conferences or in automatic voice recognition leads to reverberation and background noises becoming superimposed on voice. These unwanted signal components are compensated for by using a directional microphone having one of the patterns mentioned above, particularly via a controllable (directional-) microphone array, the main lobe of which is focused on the speaker, typically automatically.

In this context, "controllable" refers to the direction (orientation) of the main lobe, which is determined by an angle ($\phi$) which is preset or automatically orientated toward a speaker by methods of localization and voice detection (i.e., is variable), being adjustable by, in particular digital, signal postprocessing of the received signals generated by the directional microphones from an incident sound.

Therefore, a controllable first-order directional microphone is obtained in a familiar manner when a signal generated by a first-order directional microphone (e.g., pressure-difference transducer) is postprocessed via signal processing so that a desired direction ($\phi$) of the main lobe is imparted to the signal and, finally, a signal results which is proportional to $\cos(\phi+\alpha)$.

However, directional-microphone arrangements with a second-order directional pattern, particularly controllable directional-microphone arrangements, are not known.

An object of the present invention is, therefore, to specify a system and a method which ensure a, particularly controllable, second-order directional-microphone pattern.

SUMMARY OF THE INVENTION

Accordingly, in an embodiment of the present invention, a directional-microphone system is provided which includes:

- a first directional microphone with a figure-of-eight pattern ("figure-of-eight microphone") and a second figure-of-eight microphone which are arranged in such a manner that the major axis of the first figure-of-eight microphone and the major axis of the second figure-of-eight microphone extend in parallel with a first axis;
- a third figure-of-eight microphone and a fourth figure-of-eight microphone, which are arranged in such a manner that the major axis of the third figure-of-eight microphone and the major axis of the fourth one extend in parallel with a second axis, the first axis and the second axis being orthogonal to one another;
- a fifth figure-of-eight microphone which is arranged in such a manner that the major axis of the fifth-figure-of-eight microphone extends orthogonal to the major axis of the first figure-of-eight microphone; and
- a device for phase shifting which is connected downstream of the second figure-of-eight microphone and third figure-of-eight microphone.

This system ensures that, with a minimum number of directional microphones, received signals which are at least almost proportional to $\sin(\alpha)$, $\cos(\alpha)$, $\sin(\alpha)*\cos(\alpha)$, $\cos^2(\alpha)$ or $\sin^2(\alpha)$, are generated from a sound wave which comes from a direction with the angle $\alpha$ (referred to the first axis); i.e., both first-order directional microphones (received signal proportional to $\cos(\alpha)$) and second-order directional microphones (received signal proportional to $\cos^2(\alpha)$) are implemented, the filter arrangement equalizing any phase shift. In addition, the system only needs little space since the distance between the first figure-of-eight microphone and the second figure-of-eight microphone and the distance between the third figure-of-eight microphone and fourth figure-of-eight microphone is of the order of magnitude of 3 cm.

In a method according to the present invention:

a) a first arrangement of two figure-of-eight microphones with mutually parallel major axes are driven in such a manner that a first received signal proportional to $A*\cos^2(\alpha)$ is obtained;

b) a second arrangement of two figure-of-eight microphones with mutually parallel major axes are driven in such a manner that a second received signal proportional to $B*\sin^2(\alpha)$ is obtained;

c) a fifth figure-of-eight microphone with a major axis orthogonal to a figure-of-eight microphone of the first figure-of-eight microphone arrangement or a figure-of-eight microphone of the second figure-of-eight microphone arrangement is driven in such a manner that a third received signal proportional to $C*\cos(\alpha)*\sin(\alpha)$ is obtained;

d) a figure-of-eight microphone of the first figure-of-eight microphone arrangement and figure-of-eight microphone of the second figure-of-eight microphone arrangement, the major axes of which extend orthogonal to one another, are driven in such a manner that a fourth received signal proportional to $D*\cos(\alpha)+E*\sin(\alpha)$ is obtained; and e) the fourth received signal is phase-shifted by 90° and linearly combined with the sum of the first received signal, the second received signal and the third received signal, setting $A:=\cos^2(\phi)$ $B:=\sin^2(\phi)$ $C:=-2\cos(\phi)*\sin(\phi)$ $D:=\cos(\phi)$ $E:=-\sin(\phi)$, and where $\alpha$:=the direction from which a sound wave is coming $\phi$:=desired direction of the major lobe.

An advantage of the method according to the present invention is the simple implementation of a controllable directional pattern which at least approximately corresponds to a second-order directional pattern, the partial multiple use or, respectively, signal processing of individual received signals generated by the figure-of-eight microphones due to a sound incident at $\alpha$ having the result that a minimum number of figure-of-eight microphones is sufficient for generating a second-order directional pattern. In addition, a first-order directional pattern is also generated via this method (fourth received signal) so that optionally the first- or second-order directional pattern can be selected as required and the first- and second-order directional pattern also can be selected in combination so that, overall, it is possible to generate different shapes of directional patterns.

In an embodiment, postprocessing of the received signals generated by the figure-of-eight microphones is provided depending on the use of the directional-microphone system. Thus, when it is used, for example, in systems where the sound to be received comes from a preferred direction, a major lobe direction (angle $\phi$) is defined by signal processing performed by the control device, and in systems where the sound to be received does not have a preferred direction, a major lobe direction is set depending on the current direction of sound incidence via special algorithms of the signal processing.

In an embodiment, received signals of more precise proportionality to $\cos(\alpha)*\sin(\alpha)$ and $\cos 2(\alpha)$, for which these directional microphones are responsible, can be generated.

In an embodiment, received signals of more precise proportionality to $\cos(\alpha)$ and $-\sin(\alpha)$, for which these directional microphones are responsible, can be generated.

In an embodiment, a simple form of a directional microphone is provided having a figure-of-eight pattern (figure-of-eight microphone).

In an embodiment, a higher flexibility of the system with respect to the directional pattern is ensured since the figure-of-eight pattern is generated by two spherical patterns and, therefore, both figure-of-eight patterns and spherical patterns are available as required. In addition, this development has the advantage of a higher degree of freedom in the tuning of the system since the spherical microphones of the pairs of spherical microphones which, in each case, create a figure-of-eight microphone which can be repositioned.

In an embodiment, a more precise formation of the second-order directional pattern is allowed since a signal component with spherical pattern is required for precisely generating such a second-order pattern, unless it is neglected, as is generally the case, in which case the spherical pattern can be achieved, for example, via a further development of the present invention.

Additional features and advantages of the present invention are described in, and will be apparent from, the following Detailed Description of the Invention and the Figures.

DETAILED DESCRIPTION OF THE INVENTION

Figure 1:
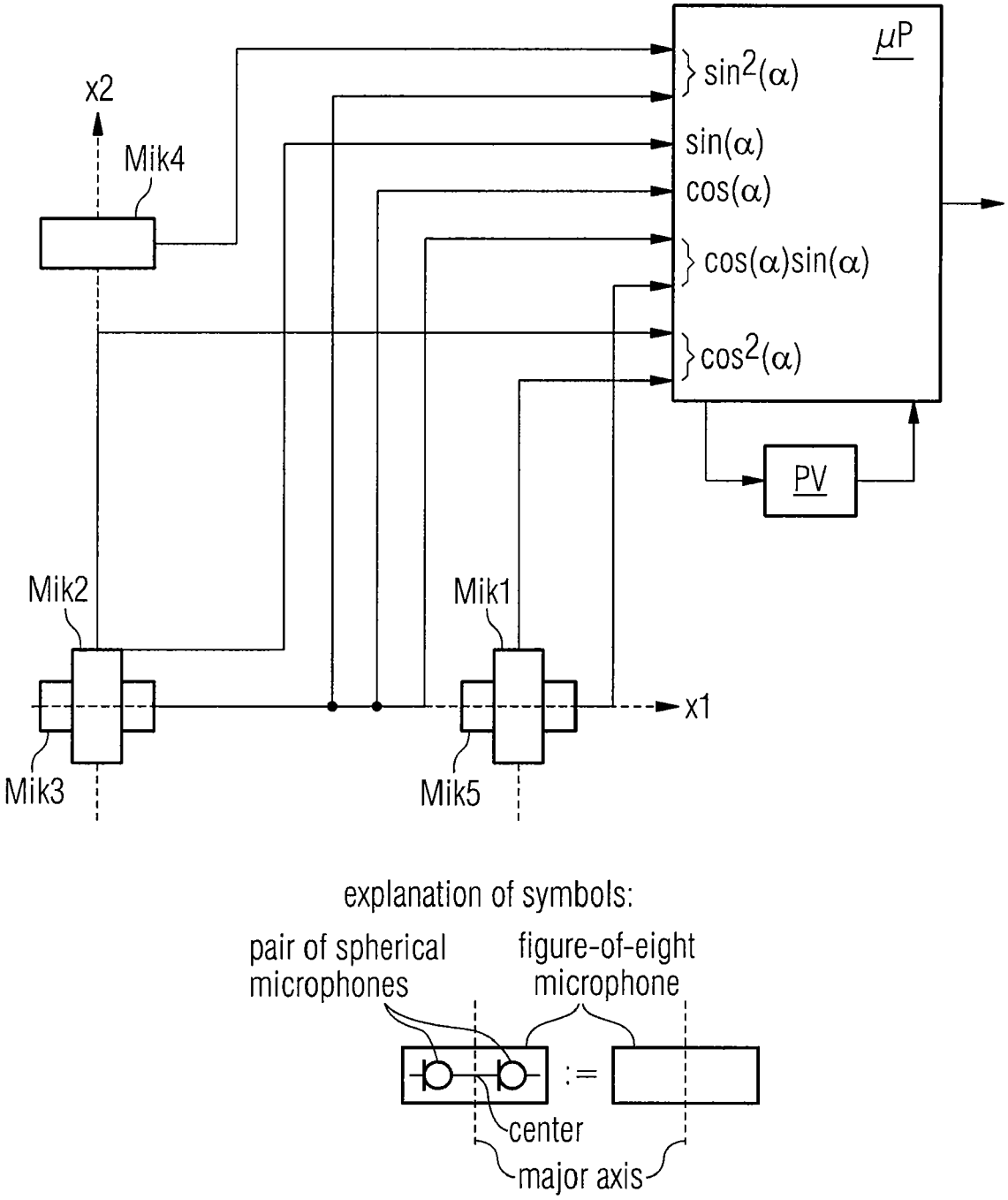
FIG. 1 shows a controllable directional-microphone system with five figure-of-eight microphones (abstract representation).

FIG. 1 shows a first axis x1 and a second axis x2. Furthermore, five directional microphones (figure-of-eight microphones) Mik1, Mik2, Mik3, Mik4 and Mik5 with figure-of-eight-shaped directional pattern (figure-of-eight pattern) can be seen, these figure-of-eight microphones in each case being formed by a pair of directional microphones with spherical pattern (spherical microphones) arranged to be offset, the figure-of-eight pattern being achieved by subtracting the signals generated by the individual spherical microphones of the pair of spherical microphones.

As an alternative to the pairs of spherical microphones, other pressure-gradient transducers also can be used as figure-of-eight microphones, or a mixed form of the individual variants, in particular with pairs of spherical microphones; e.g., in the case where at least one spherical pattern is necessary.

On the first axis x1, the first figure-of-eight microphone Mik1 and, offset thereto, the second microphone Mik2 are arranged in such a manner that their major axes extend in parallel, particularly almost coincident, with respect to the first axis x1.

The major axis of the figure-of-eight microphones Mik1, Mik2, Mik3, Mik4 and Mik5, shown in FIG. 1, extends perpendicularly and centrally with respect to the pairs of spherical microphones. In the embodiment of the figure-of-eight microphones as pressure-gradient transducers, the major axis extends perpendicularly and centrally with respect to the diaphragm or, respectively, to the sound entry opening(s).

This offset placement of the first figure-of-eight microphone Mik1 and second figure-of-eight microphone Mik2 on one axis results in a second-order directional-microphone arrangement because it supplies a received signal proportional to $\cos^2(\alpha)$ in the case of the incidence of a sound at the angle $\alpha$ (the first axis x1 is assumed to be the reference axis for angles).

On the second axis x2, the third figure-of-eight microphone Mik3 and, offset thereto, the fourth figure-of-eight microphone Mik4 are arranged in such a manner that their major axes in each case extend in parallel, particularly almost coincident with respect to the second axis x2.

This placement also results in a second-order directional-microphone arrangement but generates a received signal proportional to $\sin^2(\alpha)$ in the case of the incidence of a sound at the angle $\alpha$, the reference axis again being the first axis x1, since the second axis x2 is orthogonal to the first axis x1.

It is particularly when the second figure-of-eight microphone Mik2 and the third figure-of-eight microphone Mik3 are placed closely next to one another so that they come to be almost coincident, where, in particular, the centers of the microphones come to be almost coincident, that requirements for the space required for implementing a second-order directional-microphone arrangement are reduced to a minimum.

In this arrangement, the centers are determined by the center of the line connecting the two spherical microphones if pairs of spherical microphones are used for implementing figure-of-eight microphones, or by the center of the diaphragm if other pressure-difference transducers are used.

Due to this placement, with a sound incident at the angle $\alpha$, a received signal proportional to $\cos(\alpha)$ is generated by the second figure-of-eight microphone Mik2 on the one hand, and, on the other hand, a received signal proportional to $\sin(\alpha)$ is generated by the third figure-of-eight microphone Mik3.

In particular, the fifth figure-of-eight microphone Mik5 is placed in such a manner that it comes to be almost coincident with the first figure-of-eight microphone Mik1, in particular so that the centers (see above) come to be almost coincident.

From this placement, a received signal proportional to $\cos(\alpha)*\sin(\alpha)$ is obtained due to the offset of the first figure-of-eight microphone Mik1 and the second figure-of-eight microphone Mik2 in conjunction with the orthogonal relation of the second figure-of-eight microphone Mik2 to the third figure-of-eight microphone Mik3 with a sound incident at the angle $\alpha$.

The precise placement of the individual figure-of-eight microphones Mik1 . . . Mik5, i.e. the respective offset spacing of the microphones on the respective axes x1, x2, if coincidence with the axes x1, x2 or, respectively, the respective centers is given or if parallelism with respect to the axes x1, x2 is given, depends on various parameters. For example, mainly, on tolerances of the microphones used or required accuracy of the directional pattern and, in addition, to a slight extent on the field of use to be expected (noise background, transfer function of the space) so that, lastly, it must be determined by simulation and/or test configurations in conjunction with suitable measurements, and slight variations are therefore possible.

To achieve controllability of the figure-of-eight microphone arrangement described, the figure-of-eight microphones Mik1 . . . Mik5 are linked to a control device μP; for example, a microprocessor. In this context, controllability refers to the respective received signals of the individual figure-of-eight microphones Mik1 . . . Mik5 being processed further, preferably digitally, in such a manner that they are in each case associated with coefficients or factors depending on an angle $\phi$, the angle $\phi$ (also referred to the first axis x1) being the desired orientation of the major lobe.

The decision whether the orientation is predefined or should be variable depends on the planned type of use of a directional-microphone system and is reflected in the algorithms used for defining the orientation $\phi$.

Furthermore, the control device drives the figure-of-eight microphone system described in such a manner that it now implements a controllable first-order directional-microphone system and/or a controllable second-order directional-microphone system.

A directional-microphone system with a general second-order directional pattern is achieved via an output signal of the system which is proportional to $$K+L*\cos(\alpha+\phi)+M*\cos^2(\alpha+\phi)$$

where the term (coefficient) K is obtained by a signal having a spherical pattern, the term $L*\cos(\alpha+\phi)$ is obtained with a signal having a first-order figure-of-eight pattern and the term $M*\cos^2(\alpha+\phi)$ is obtained with a signal having a second-order figure-of-eight pattern and where the term K is generally negligible so that it is essentially sufficient to generate a first-order figure-of-eight pattern and a second-order figure-of-eight pattern.

For a first-order figure-of-eight pattern, therefore, the system is driven in a method step in such a manner that two of the figure-of-eight microphones Mik1 . . . Mik5 are selected which, with a sound incident at $\alpha$, generate received signals, one of which is proportional to $\cos(\alpha)$ (third figure-of-eight microphone Mik3) and one of which is proportional to $\sin(\alpha)$ (second figure-of-eight microphone Mik2), these received signals being combined linearly in accordance with the following formula $$D*\cos(\alpha)+E*\sin(\alpha).$$

To obtain a shape proportional to $\cos(\alpha+\phi)$, the factor $D=\cos(\phi)$ and the factor $E=-\sin(\phi)$ are now generated in a signal processing step so that, according to the theorem of addition $$\cos(x+y)=\cos(y)*\cos(x)-\sin(y)*\sin(x)$$

the signal (fourth received signal)

$$\cos(\alpha+\phi)=\cos(\alpha)*\cos(\alpha)-\sin(\phi)*\sin(\alpha)$$

is obtained.

To generate a second-order figure-of-eight pattern, therefore, in a further method step two further figure-of-eight microphones (first figure-of-eight microphone Mik1 and second figure-of-eight microphone Mik2) of the figure-of-eight microphones Mik1 . . . Mik5 are selected which generate a first received signal which is proportional to $\cos^2(\alpha)$ with the sound incident at $\alpha$, and the third figure-of-eight microphone Mik2 and fourth figure-of-eight microphone Mik4 are selected which generate a second received signal proportional to $\sin^2(\alpha)$ in conjunction with one another.

Furthermore, the third figure-of-eight microphone Mik3 and the fifth figure-of-eight microphone Mik5 are selected which generate a third received signal proportional to $\sin(\alpha)*\cos(\alpha)$ in conjunction with one another.

The first, second and third received signal are then combined in a signal processing step according to the following formula $$A*\cos^2(\alpha)+B*\sin^2(\alpha)+C*\cos(\alpha)*\sin(\alpha).$$

To obtain a signal according to $\cos^2(\alpha+\phi)$, the factors A, B and C are developed by signal processing, using the theorem of addition $$\begin{aligned}\cos^2(x+y) &= [\cos(y)*\cos(x)-\sin(y)*\sin(x)]^2\\ &= \cos^2(y)*\cos^2(x)-2*\sin(y)*\sin(x)*\cos(y)*\\ &\quad \cos(x)+\sin^2(y)*\sin^2(x)\end{aligned}$$

in the following manner $A=\cos^2(\phi)$ $B=\sin^2(\phi)$ $C=-2*\sin(\phi)*\cos(\phi)$, resulting in the second-order figure-of-eight pattern according to $\cos 2(\phi+\alpha)$.

Lastly, in order to implement the controllable directional-microphone system having a general second-order directional pattern, a phase shift by 90°, which exists between the first-order figure-of-eight pattern and the second-order figure-of-eight pattern, is firstly equalized via a device (for example, a Hilbert filter) which is connected downstream of the second figure-of-eight microphone Mik2 and the third figure-of-eight microphone Mik3, so that a fifth received signal is produced, and then the first, second, third and fourth received signal are added, weighted with factors.

If the component of the spherical pattern (term K) of the general second-order directional pattern is not to be neglected, this component can be generated as a fifth received signal, for example in an implementation of the figure-of-eight microphones Mik1 . . . Mik5 via spherical microphones, by picking up at least one of the signals generated by the individual spherical microphones and then processing the signal.

As an alternative, it is also possible to combine the first and second received signal linearly in such a manner that a fifth received signal with spherical pattern is obtained which is then added, weighted with a factor, to the sum of the first, second, third and fourth received signal.

The exemplary embodiment only represents one of the embodiments possible according to the present invention. Thus, an expert active in this field is capable of creating a multiplicity of further embodiments via advantageous modifications (e.g., modifications of the method steps, modification of the placement of the microphones, use) without changing the character (nature) of the present invention (minimum number of directional microphones due to multiple use for the signal processing, generation of suitable trigonometric functions in dependence on the orientation of the main lobe for generating necessary patterns, etc). These embodiments are also to be covered by the present invention.

The invention claimed is:

1. A directional-microphone system, comprising:

a first figure-of-eight microphone and a second figure-of-eight microphone particularly arranged such that a major axis of the first figure-of-eight microphone and a major axis of the second figure-of-eight microphone extend in parallel with a first axis;

a third figure-of-eight microphone and a fourth figure-of-eight microphone particularly arranged such that a major axis of the third figure-of-eight microphone and a major axis of the fourth figure-of-eight microphone extend in parallel with a second axis, the first axis and the second axis being orthogonal to one another;

a fifth figure-of-eight microphone particularly arranged such that a major axis of the fifth figure-of-eight microphone extends orthogonal to the major axis of the first figure-of-eight microphone; and a device for phase shifting connected downstream of two of the figure-of-eight microphones whose respective major axes extend orthogonal to one another.

2. A directional-microphone system as claimed in claim 1, further comprising a control device connected to at least one of the arrangement of the first figure-of-eight microphone and the second figure-of-eight microphone, the arrangement of the third figure-of-eight microphone and the fourth figure-of-eight microphone, and the fifth figure-of-eight microphone, such that a respective major lobe orientation of the directional-microphone system can be varied.

3. A directional-microphone system as claimed in claim 1, wherein the first figure-of-eight microphone and the fifth figure-of-eight microphone are particularly arranged such that the first figure-of-eight microphone and the fifth figure-of-eight microphone are adjacent to one another.

4. A directional-microphone system as claimed in claim 1, wherein the first figure-of-eight microphone and the fifth figure-of-eight microphone are particularly arranged such that a center of the first figure-of-eight microphone and a center of the fifth figure-of-eight microphone are substantially coincident.

5. A directional-microphone system as claimed in claim 1, wherein the second figure-of-eight microphone and the fifth figure-of-eight microphone are particularly arranged such that the second figure-of-eight microphone and the third figure-of-eight microphone are substantially coincident.

6. A directional-microphone system as claimed in claim 1, wherein the second figure-of-eight microphone and the fifth figure-of-eight microphone are particularly arranged such that a center of the second figure-of-eight microphone and a center of the third figure-of-eight microphone are substantially coincident.

7. A directional-microphone system as claimed in claim 1, wherein at least some of the figure-of-eight microphones are designed as pressure-gradient transducers.

8. A directional-microphone system as claimed in claim 7, wherein at least some of the figure-of-eight microphones are respectively implemented by two spherical microphones arranged offset to one another.

9. A method for signal processing in a directional-microphone system, the method comprising the steps of:

driving a first arrangement of two figure-of-eight microphones with mutually parallel major axes such that a first received signal proportional to $A*\cos 2(\alpha)$ is obtained;

driving a second arrangement of two figure-of-eight microphones with mutually parallel major axes such that a second received signal proportional to $B*\sin^2(\alpha)$ is obtained;

driving a fifth figure-of-eight microphone with a major axis orthogonal to a figure-of-eight microphone of one of the first arrangement and the second arrangement such that a third received signal proportional to $C*\cos(\alpha)*\sin(\alpha)$ is obtained;

driving a figure-of-eight microphone of the first arrangement and a figure-of-eight microphone of the second arrangement, the major axes of which extend orthogonal to one another, such that a fourth received signal proportional to $D*\cos(\alpha)+E*\sin(\alpha)$ is obtained; and phase-shifting the fourth received signal by 90° and linearly combining it with a sum of the first received signal, the second received signal and the third received signal, in each case weighted with factors, setting $A:=\cos^2(\phi)$ $B:=\sin^2(\phi)$ $C:=-2\cos(\phi)*\sin(\phi)$ $D:=\cos(\phi)$ $E:=-\sin(\phi)$, and where $\alpha$:=a direction from which a sound wave is coming $\phi$:=desired direction of a major lobe of the directional-microphone system.

10. A method for signal processing in a directional-microphone system as claimed in claim 9, the method further comprising the steps of:

linearly combining the first received signal and the second received signal such that a fifth received signal having a spherical directional-microphone pattern is formed; and linearly combining the first received signal, the second received signal, the third received signal, the fourth received signal and the fifth received signal, weighted with factors.

* * * * *